United States Patent [19]

Mizude

[11] Patent Number: 4,996,562

[45] Date of Patent: Feb. 26, 1991

[54] CONTROL DEVICE IN IMAGE FORMING APPARATUS

[75] Inventor: Kazuhiro Mizude, Osaka, Japan

[73] Assignee: Mita Industrial Co., Ltd., Osaka, Japan

[21] Appl. No.: 461,748

[22] Filed: Jan. 8, 1990

[30] Foreign Application Priority Data

Jan. 14, 1989 [JP] Japan ..... 1-7157

[51] Int. Cl.[5] ..... G03G 15/00

[52] U.S. Cl. ..... 355/205; 355/308; 340/679; 364/550

[58] Field of Search ..... 355/203-206, 355/308; 340/679; 364/550

[56] References Cited

U.S. PATENT DOCUMENTS 4,449,812 5/1984 Furnichi et al. ..... 355/206 X 4,951,235 8/1990 Mori ..... 364/550

FOREIGN PATENT DOCUMENTS 1-178973 7/1989 Japan ..... 355/204

*Primary Examiner*—Joan H. Pendegrass

*Attorney, Agent, or Firm*—Antonelli, Terry, Stout & Kraus

[57] ABSTRACT

A control device in an image forming apparatus whose main body is connected to one or more options through two-way serial lines having feeding and receiving lines, can determine whether the main body of the image forming apparatus and each of the options are not connected or not, or the power supply of the option is off or not on the basis of determination whether a signal level on the receiving serial line is a reference level or less or more over a predetermined constant time period if a response signal from the option is not sent back to the main body and correspondingly, can automatically subject the option to suitable control processing.

2 Claims, 3 Drawing Sheets

CONTROL DEVICE IN IMAGE FORMING APPARATUS

BACKGROUND OF THE INVENTION

The present invention relates to a control device used in an image forming apparatus whose main body is connected to one or more options through two-way serial lines comprising transmission and reception lines and capable of determining the state of each of the options.

Description is made using an electrophotographic copying apparatus which is one example of an image forming apparatus. Recent electrophotographic copying apparatuses have a lot of functions and can be provided with various options. For example, an electrophotographic copying apparatus can be provided, as an option, with a soter for sorting copied sheets, an automatic document feeder (referred to as ADF hereinafter) for automatically setting a document, a special cassette in which a great many paper sheets can be contained, a duplex copy unit for making duplex copies, various display devices, or the like. In addition, some options may be, in some cases, provided for the main body of the electrophotographic copying apparatus as standard equipment.

When the main body of the electrophotographic copying apparatus is provided with the above option, the main body and the option are connected through a connecting line such that signals can be transmitted and received. A system using a serial line comprising a feeding line and a receiving line as an example of this connecting line has been proposed. In this proposed system, a signal is applied to the option from a main body controller in the electrophotographic copying apparatus through the feeding line and correspondingly, a response signal is sent back to the main body controller from the option through the receiving line.

In the system comprising such a serial line, when there occurs an abnormality in any one of a plurality of the options connected to the main body of the electrophotographic copying apparatus, for example, an abnormality in the connection betweem the main body and the option or an abnormality in the option itself, the abnormality must be quickly detected. An apparatus for quickly detecting an abnormality in an option has been proposed in Japanese Patent Laid-Open Gazette No. 103297/1986. More specifically, proposed is an apparatus, adapted such that a response signal is sent back from each option with respect to data sent out from a main body controller in an electrophotographic copying apparatus, for determining that an error occurs in the option when the response signal is not sent back a predetermined number of times with respect to the data repeatedly sent out from the main body controller in the electrophotographic copying apparatus. Consequently, it can be immediately determined which option is erroneous.

Meanwhile, when an abnormality is detected in an option, a case is rare where the option itself is not operated by a failure. In many cases, an abnormality is caused by elementary errors, for example, such errors that the main body of the electrophotographic copying apparatus and the option are not connected or the power supply of the option is off. When such an abnormality is detected, it is preferable to determine whether the main body of the electrophotographic copying apparatus and the option are not connected or not, or the power supply of the option is off or not and automatically perform predetermined processing on the basis of the results of the determination.

However, in the above described apparatus proposed in Japanese Patent Laid-Open Gazette No. 103297/1986, it can not be determined whether the main body of the electrophotographic copying apparatus and the option are not connected or not, or the power supply of the option is off or not. Accordingly, even if the abnormality in the option is detected, processing conforming to the contents of the abnormality can not be automatically performed.

Although description was made using an electrophotographic copying apparatus as an example, a printer which can be equipped with a sorter and a special cassette has been commercially available in recent years. In such a printer, there is the same problem to be solved.

SUMMARY OF THE INVENTION

An object of the present invention is to provide a control device in an image forming apparatus whose main body is connected to one or more options through two-way serial lines comprising feeding and receiving lines, which can determine whether the main body of the image forming apparatus and each of the options are not connected (an abnormality in connection) or not, or the power supply of the option itself is off or not when an abnormality in the option of the image forming apparatus is detected and need not increase the number of connecting lines.

In order to attain the above described object, the present invention provides a control device in an image forming apparatus characterized by comprising (a) response signal determining means for determining whether or not a predetermined response signal is sent back from an option with respect to a signal outputted from the main body of the image forming apparatus; (b) signal level determining means, when the above response signal determining means determines that the response signal is not sent back, for determining that a signal level on a receiving serial line for sending a signal from the option to the main body is a reference level or more or less, over a predetermined constant time period or more, said reference level being set lower than a signal level on the receiving serial line in a case where the option is not connected to the main body of the image forming apparatus so that one end of the receiving serial line is opened, or said reference level being set higher than a signal level on the receiving serial line in a case where the option is connected to the main body of the image forming apparatus but the power supply of the option is off; and (c) state determining means responsive to a determination output of the above signal level determining means for determining whether the main body of the image forming apparatus and the option are not connected or not, or the power supply of the option is off or not.

Out of the feeding line and the receiving line for connecting the main body of the image forming apparatus to the option, the receiving line for sending a signal from the option to the main body of the image forming apparatus attains a predetermined reference level or more, i.e., a high level, if the option is not connected to the receiving line and a terminal of the receiving line is opened. On the other hand, the receiving line attains a predetermined reference level or less, i.e., a low level, if the power supply of the option is off with the option being connected to the receiving line.

The signal level determining means and the state determining means on the side of the main body of the image forming apparatus can determine the signal level on the receiving serial line if a predetermined response signal is not sent back from the option, to allow determination whether the option is not connected to the main body of the image forming apparatus or not, or the power supply of the option is off or not.

DESCRIPTION OF THE PREFERRED EMBODIMENTS

A control device in an electrophotographic copying apparatus will be described in detail by way of example.

Figure 2:
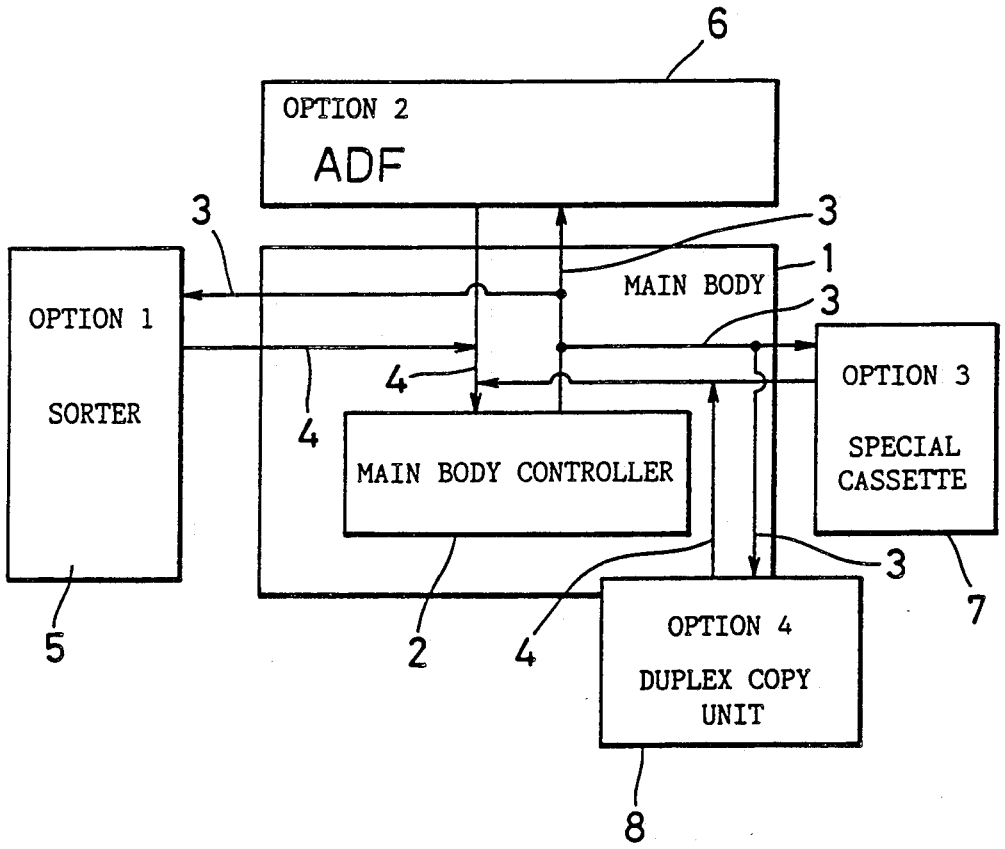
FIG. 2 is a block diagram showing the main body of an electrophotographic copying apparatus to which a plurality of options are connected.

FIG. 2 is a block diagram showing the main body of the electrophotographic copying apparatus to which a plurality of options are connected in an embodiment of the present invention. Referring to FIG. 2, the main body of the electrophotographic copying apparatus is provided with a main body controller 2. When the options are mounted on the main body of the electrophotographic copying apparatus 1, the main body controller 2 and each of the options are connected through a two-way serial line comprising a feeding line 3 and a receiving line 4. FIG. 2 shows a state where a sorter 5 for sorting copied sheets, an ADF 6 for automatically setting a document, a special cassette 7 in which a great many paper sheets can be contained, and a duplex copy unit 8 for making duplex copies are mounted on the main body controller 2 as examples of the options.

In addition to the options shown in FIG. 2, various display devices, a miniprinter for printing maintenance management data, or the like have been known as options. Any option is connected to the main body controller 2 through the two-way serial line comprising the feeding line 3 and the receiving line 4.

Figure 3:
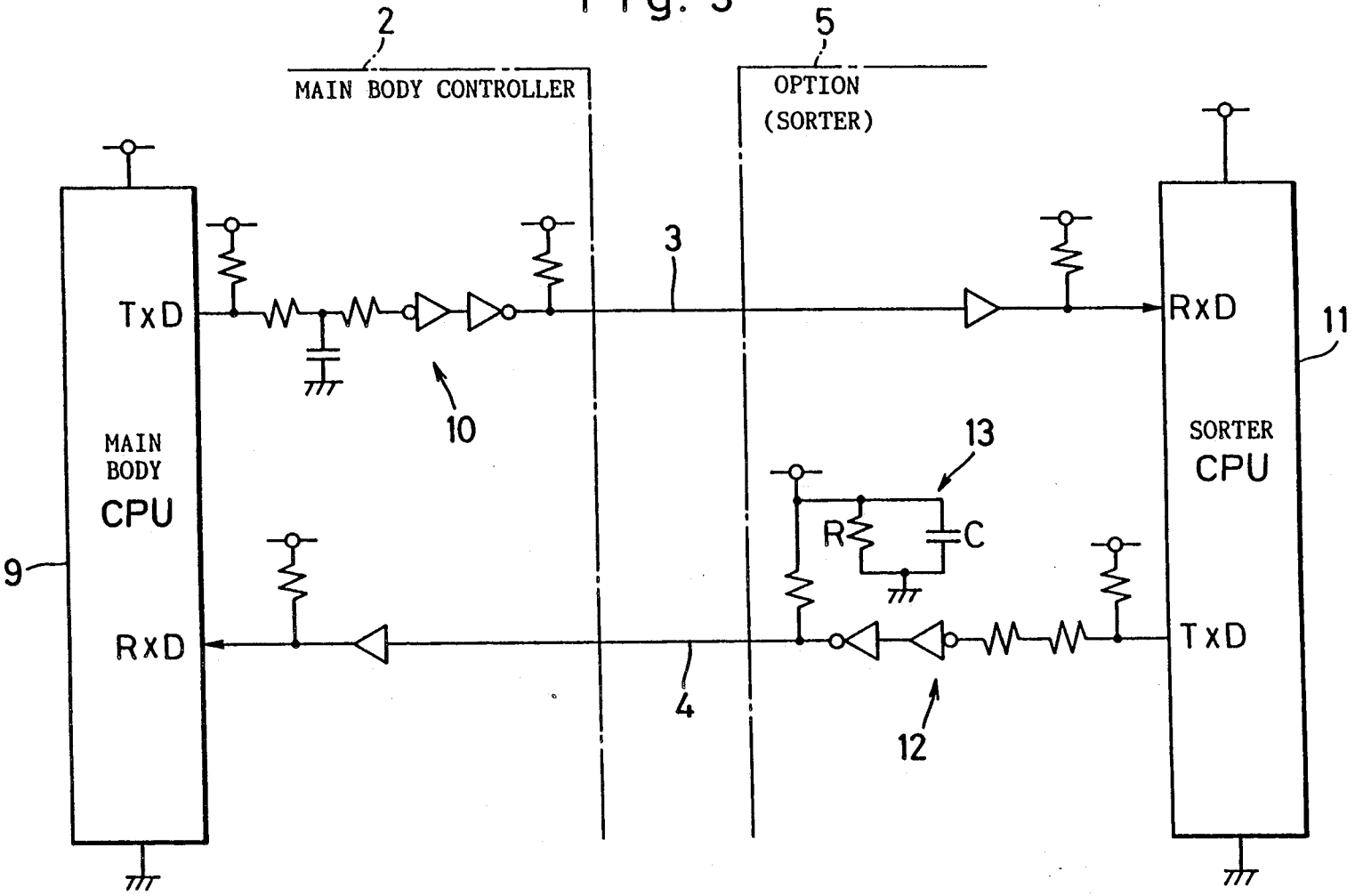
FIG. 3 is a detailed circuit diagram showing the main body of the electrophotographic copying apparatus to which a single option (sorter) is connected.

FIG. 3 is a circuit block diagram showing the main body controller 2 to which a single option, for example, the sorter 5 is connected. The main body controller 2 includes a main body-CPU (central processing unit) 9. A signal outputted from an output terminal TxD of the main body-CPU 9 is applied to an input terminal RxD of a sorter-CPU 11 provided in the sorter 5 via the feeding line 3 after passing through an output circuit 10.

On the other hand, a response signal outputted from an output terminal TxD of the sorter-CPU 11 is applied to an input terminal RxD of the main body-CPU 9 via a receiving line 4 after passing through an output circuit 12. In this case, the output circuit 12 in the sorter 5 includes an RC (relay controller) circuit 13, which is adapted such that a signal level on the receiving line 4 is lowered to a GROUND level (a low level) if the power supply of the sorter 5 is turned off.

The connection between the main body controller 2 and another option is made exactly the same as the above described connection between the main body controller 2 and the sorter 5.

Figure 1:
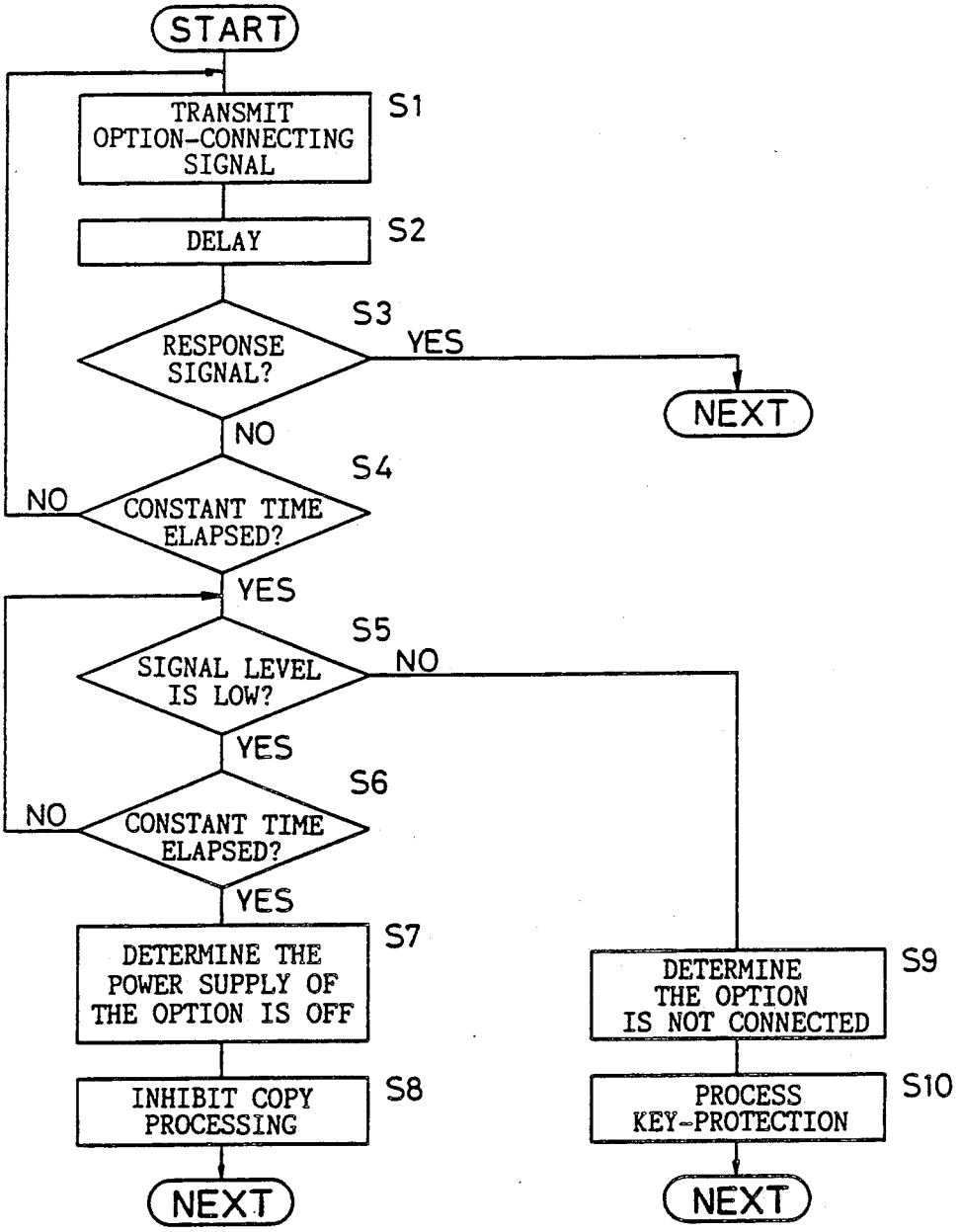
FIG. 1 is a flow chart showing the control procedure of a control device according to an embodiment of the present invention.

FIG. 1 is a flow chart showing a control operation performed by the main body-CPU 9 shown in FIG. 3 for detecting an abnormality. The main body-CPU 9 sequentially performs a control operation shown in FIG. 1 with respect to options connected to the main body controller 2. For simplicity, a control operation with respect to the sorter 5 which is one of the options will be described herein.

When the control operation is started, the main body-CPU 9 transmits an option-connecting signal to the sorter 5 through the feeding line 3 (step S1). After a predetermined delay time has elapsed (step S2), the presence or absence of a response signal from the sorter 5 is determined (step S3). If the response signal is sent back from the sorter 5, it is determined that the sorter 5 is normally connected and operated. Accordingly, the program proceeds to another data transmission processing.

When the response signal is not sent back from the sorter 5 (step S3), the main body-CPU 9 determines whether or not a predetermined constant time period has elapsed (step S4). If a constant time period has not elapsed, the control operation beginning with the step S1 is repeated.

When the response signal is not sent back from the sorter 5 even after a constant time period has elapsed, the main body-CPU 9 determines whether or not the signal level on the receiving line 4 is a low level (step S5). The determination can be carried out by setting a reference level slightly above the low level and comparing the signal level with the reference level. If the signal level on the receiving line 4 is not a low level, the main body-CPU 9 determines that the sorter 5 is not connected to the main body controller 2 (step S9), to perform key-protection processing for disenabling a key (an operation setting key, a mode designation key or the like) for the sorter 5 provided in the main body 1 of the electrophotographic copying apparatus (step S10). At the same time, it may be indicated that the sorter is not connected. Consequently, the key for the sorter 5 does not function. However, copies can be made in the main body 1 of the electrophotographic copying apparatus. Copied sheets are discharged to an ordinary discharge tray. After the key-protection processing (step S10), the program proceeds to the next processing.

In the step S5, if the signal level on the receiving line 4 is a low level, the main body-CPU 9 determines whether or not the low level state lasts for a constant time period (step S6). If a constant time period has elapsed with the signal level on the receiving line 4 being a low level, the main body-CPU 9 determines that the power supply of the sorter 5 is off (step S7). In such a case, a print key (not shown) provided in the main body 1 of the electrophotographic copying apparatus is disenabled, to inhibit copy processing (step S8). Thereafter, the program proceeds to the next processing.

Although in the present embodiment, it is determined in the step S4 whether or not a constant time period has elapsed in a case where there is no response from the sorter 5, it may be determined whether or not the number of times of transmission of the option-connecting signal (step S1) becomes a predetermined number of times instead of determining whether or not a constant time period has elapsed.

Although description was made of a case where the option is the sorter 5, other options may be used. In such a case, processing in the steps S8 and S10 may be suitably changed depending on the types of the other options.

Furthermore, although description was made of the electrophotographic copying apparatus, the description can be also applied to other image forming apparatuses such as a printer.

The control device in the electrophotographic copying apparatus according to the present invention is constructed as described in the foregoing. Accordingly, in a case where there is an option connected to the main body of an image forming apparatus by a two-way serial line comprising feeding and receiving lines, if a response signal from the option is not sent back to the side of the main body, it can be determined whether or not the option is not connected to the main body of the image forming apparatus or not, or the power supply of the option is off or not, and correspondingly, the option can be automatically subjected to suitable control processing.

Additionally, in a case where there are a plurality of options connected to the main body of an image forming apparatus, it can be quickly determined which option is abnormal and the abnormal option can be quickly restored, similarly to the control device in the conventional electrophotographic copying apparatus.

Having described the present invention in detail with reference to the accompanying drawings, the present invention is not limited to the above described particular embodiments. It should be understood that various modifications may be made without departing from the scope of the present invention.

What i claim is:

1. A control device used in an image forming apparatus whose main body is connected to one or more options through two-way serial lines comprising feeding and receiving lines, comprising:

response signal determining means for determining whether or not a predetermined response signal is sent back from an option with respect to a signal outputted from the main body of the image forming apparatus;

signal level determining means, when said response signal determining means determines that the response signal is not sent back, for determining that a signal level on the receiving serial line for sending a signal to the main body from the option is a reference level or more or less, over a predetermined constant time period, said reference level being set lower than a first signal level on the receiving serial line in a case where the option is not connected to the main body of the image forming apparatus so that one end of the receiving serial line is opened, and said reference level being set higher than a second signal level on the receiving serial line in a case where the option is connected to the main body of the image forming apparatus but the power supply of the option is off, and state determining means responsive to an output of said signal level determining means for determining whether the main body of the image forming apparatus and the option are not connected or not, or the power supply of the option is off or not.

2. The control device in the image forming apparatus according to claim 1, wherein said option comprises a sorter for sorting copied sheets, an automatic document feeder for automatically setting a document, a special cassette in which a great many copy sheets can be contained, a duplex copy unit for making duplex copies, various display devices, or a miniprinter for printing maintenance management data.

* * * * *